US008137641B2

(12) United States Patent
Moles

(10) Patent No.: US 8,137,641 B2
(45) Date of Patent: Mar. 20, 2012

(54) MICROFLUIDIC MODULE INCLUDING AN ADHESIVELESS SELF-BONDING REBONDABLE POLYIMIDE

(75) Inventor: Donald R. Moles, Cedarville, OH (US)

(73) Assignee: YSI Incorporated, Yellow Springs, OH (US)

( * ) Notice: Subject to any disclaimer, the term of this patent is extended or adjusted under 35 U.S.C. 154(b) by 0 days.

(21) Appl. No.: 13/028,550

(22) Filed: Feb. 16, 2011

(65) Prior Publication Data

US 2011/0132870 A1 Jun. 9, 2011

Related U.S. Application Data

(62) Division of application No. 11/856,227, filed on Sep. 17, 2007, now abandoned.

(51) Int. Cl.
*C03C 25/68* (2006.01)
*B32B 38/10* (2006.01)
*B32B 37/02* (2006.01)

(52) U.S. Cl. ..... 422/504; 216/41; 216/47; 216/48; 216/58; 216/78; 156/60; 156/308.2

(58) Field of Classification Search ..... None
See application file for complete search history.

(56) References Cited

U.S. PATENT DOCUMENTS 4,304,257 A 12/1981 Webster
4,848,722 A 7/1989 Webster
4,852,851 A 8/1989 Webster
4,858,883 A 8/1989 Webster
5,262,227 A 11/1993 Takabayashi et al.
5,262,277 A 11/1993 Sato et al.
5,525,405 A 6/1996 Coverdell et al.
5,660,370 A 8/1997 Webster
5,741,598 A 4/1998 Shiotani et al.
5,891,986 A 4/1999 Yamaguchi et al.
5,906,886 A 5/1999 Yamaguchi et al.
5,932,799 A 8/1999 Moles
6,073,482 A 6/2000 Moles
6,129,982 A 10/2000 Yamaguchi et al.
6,136,212 A 10/2000 Mastrangelo et al.
6,293,012 B1 9/2001 Moles
6,382,254 B1 5/2002 Yang et al.
6,406,605 B1 6/2002 Moles (Continued)

FOREIGN PATENT DOCUMENTS

EP 1345773 8/2006

OTHER PUBLICATIONS

US, Office Action, U.S. Appl. No. 11/856,227 (Apr. 28, 2010).

(Continued)

*Primary Examiner* — In Suk Bullock
*Assistant Examiner* — Timothy G Kingan
(74) *Attorney, Agent, or Firm* — Thompson Hine LLP

(57) ABSTRACT

A method of making a microfluidic module is disclosed that includes forming a fluid flow channel in a self-bonding rebondable polyimide film to provide a channel sheet, the self-bonding rebondable polyimide film having a first mask layer self-bonded thereto; removing the first mask layer from the channel sheet after forming the fluid flow channel; and self-bonding the surface of the channel sheet exposed by removal of the first mask layer to a cover sheet.

17 Claims, 6 Drawing Sheets

U.S. PATENT DOCUMENTS

| | | | | |
|---|---|---|---|---|
| 6,501,654 | B2 | 12/2002 | O'Connor et al. | |
| 6,521,188 | B1 | 2/2003 | Webster | |
| 6,527,003 | B1 | 3/2003 | Webster | |
| 6,551,496 | B1 | 4/2003 | Moles et al. | |
| 6,605,366 | B2 | 8/2003 | Yamaguchi et al. | |
| 6,622,746 | B2 | 9/2003 | Yang et al. | |
| 6,824,827 | B2 | 11/2004 | Katsuki et al. | |
| 7,186,383 | B2 | 3/2007 | Webster et al. | |
| 7,186,456 | B2 | 3/2007 | Hashimoto et al. | |
| 7,220,334 | B2 * | 5/2007 | Anazawa et al. | 156/235 |
| 2003/0153476 | A1 | 8/2003 | Akita et al. | |
| 2004/0052057 | A1 | 3/2004 | Ohmi et al. | |
| 2004/0101442 | A1 | 5/2004 | Frechet et al. | |
| 2005/0121138 | A1 | 6/2005 | Hoshida et al. | |
| 2005/0238506 | A1 | 10/2005 | Mescher et al. | |
| 2006/0245933 | A1 | 11/2006 | Balch et al. | |
| 2007/0154355 | A1 | 7/2007 | Berndt et al. | |

OTHER PUBLICATIONS

US, Office Action, U.S. Appl. No. 11/856,227 (Oct. 27, 2010).
US, Advisory Action, U.S. Appl. No. 11/856,227 (Jan. 11, 2011).
PCT, International Preliminary Report on Patentability, International Application No. PCT/US2008/075540 (Mar. 24, 2010).
PCT, International Search Report and Written Opinion, International Application No. PCT/US2008/075540 (Dec. 8, 2008).
Product literature entitled "Development of Heat Bonding Type Polyimide Film UPILEX VT," by UBE Industries, Ltd. (date of first publication unknown).

* cited by examiner

MICROFLUIDIC MODULE INCLUDING AN ADHESIVELESS SELF-BONDING REBONDABLE POLYIMIDE

CROSS REFERENCE TO U.S. PATENT APPLICATION

This application is a divisional of U.S. patent application Ser. No. 11/856,227 filed Sep. 17, 2007.

FIELD OF INVENTION

The present application relates to a microfluidic module.

BACKGROUND

Microfluidic modules are useful in various applications. Microfluidic modules can be used to test small amounts of samples in fluid systems for contaminants, chemicals, or other analytes. Microfluidic modules may be used in the body, water systems, industrial fluid systems, or any of a variety of systems having liquid or gaseous components.

Microfluidic modules have been made from a variety of materials. One material is a self-bonding polyimide film that may be etched to form channels. The etched films are then layered and bonded together as described in the commonly assigned U.S. Pat. No. 5,932,799. The self-bonding polyimide film disclosed in the '799 patent contains an organotin compound that is employed in a single bonding operation. The organotin compounds react during bonding, and once bonded are not available for use in a second or subsequent bonding operation.

SUMMARY

One embodiment disclosed is a microfluidic module that comprises a self-bonding rebondable polyimide film. In a particular embodiment, the self-bonding rebondable polyimide film includes at least one fluid flow channel therein. In a still more particular embodiment, a film including a fluid flow channel is bonded to a cover sheet. The cover sheet may be a different plastic or metal but in a particular embodiment it is also a film of a self-bonding rebondable polyimide.

Another embodiment is a method of making microfluidic modules. The method includes forming a fluid flow channel in a self-bonding rebondable polyimide film to provide a channel sheet, the self-bonding rebondable polyimide film having a first mask layer self-bonded thereto; removing the first mask layer from the channel sheet after forming the fluid flow channel; and self-bonding the surface of the channel sheet exposed by removal of the first mask layer to a cover sheet. The step of forming of the fluid flow channel may include etching the first mask layer with a fluidic pattern and etching the fluid flow channel into the self-bonding rebondable polyimide film through the etched mask layer.

DETAILED DESCRIPTION

Figure 1:
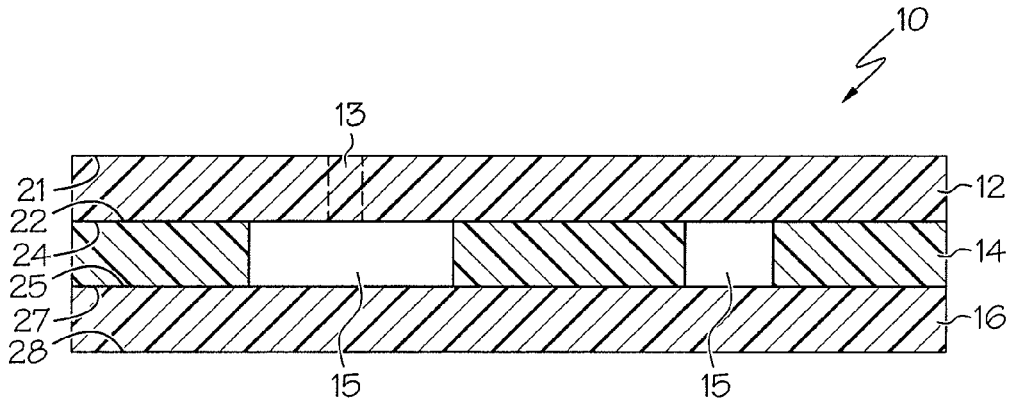
FIG. 1 is a sectional view of one embodiment of a microfluidic module.

The following description is intended to be representative only and not limiting. Many variations can be anticipated according to these teachings, which are included within the scope of the present invention. Reference will now be made in detail to the various embodiments of the present invention, examples of which are illustrated in the accompanying drawings.

As used herein "rebondable polyimide" refers to a polyimide that can be heat and/or pressure bonded to a material, e.g., a first sheet, in one bonding operation resulting in a composite containing the polyimide. The composite can be re-heat- and/or re-pressure-bonded alone, or in the form of a multilayer structure or module, to a second sheet or module, in a subsequent bonding operation. Thus, the rebondable polyimide is characterized in that it can be used in two or more bonding operations.

One example of a self-bonding rebondable polyimide is UPILEX® VT polyimide film available from UBE Industries, Ltd. The self-bonding rebondable polyimide films used in the modules of the present invention can be distinguished from the self-bonding polyimide films disclosed in U.S. Pat. No. 5,525,405 to Coverdell et al. The Coverdell et al. film is not rebondable. The film contains an organotin compound, the reactivity of which is exhausted after a single bonding operation. Thus, in making microfluidic modules using the Coverdell et al. films, the multiple layers of polyimide films must be stacked and bonded in one operation. Using VT polyimide, for example, the microfluidic module may be made by stacking rebondable polyimide films to form modules or sub-modules in multiple steps with multiple bonding operations and the final product can be built up of multiple modules or sub-modules that are bonded together in a subsequent bonding operation.

Examples of rebondable polyimide films that may be useful in the module are disclosed in U.S. Pat. No. 5,262,227, U.S. Pat. No. 5,741,598, U.S. Pat. No. 6,605,366, and U.S. Pat. No. 6,824,827 all commonly assigned to UBE Industries, Ltd., which are incorporated herein by reference. U.S. Pat. No. 5,262,277 describes an aromatic polyimide film that may have a metal foil directly fixed on the surface (Layer B or B') of the substrate film with no adhesive. The aromatic polyimide substrate film is described as having a Layer A-Layer B construction or a Layer B-Layer A-Layer B' construction. Layer A is a biphenyltetracarboxylic acid or its derivative (preferably the acid dianhydride) and a phenylenediamine. Layer B and layer B' are basically the same and are derived from an aromatic tetracarboxylic acid or its derivatives and an aromatic diamine having two or more benzene rings.

Layer A may be an aromatic polyimide which is derived from a biphenyltetracarboxylic acid or its derivative and a phenylenediamine. Examples of the biphenyltetracarboxylic acid are 3,3',4,4'-biphenyltetracarboxylic acid and 2,3,3',4'-biphenyltetracarboxylic acid. Examples of their derivatives are their acid anhydrides and their esters. Their acid dianhydrides are preferred. These biphenyltetracarboxylic acids or their derivatives can be used in combination with other aromatic tetracarboxylic acids (e.g., pyromellitic acid and 3,3',4,4'-benzophenonetetracarboxylic acid) or their derivatives (e.g., dianhydride), provided that the content of the latter acids or derivatives does not exceed 40 molar % of the total content of tetracarboxylic acids and their derivatives. Examples of the phenylenediamine are o-, m-, and p-phenylenediamine. The phenylenediamine also can be used in combination with other aromatic diamines (e.g., 4,4'-diaminodiphenylether, 3,4'-diaminodiphenylether, 4,4'-diaminodiphenylsulfone, and 3,4'-diaminodiphenylsulfone), provided that the content of the other aromatic diamines does not exceed 50 molar % of the total content of aromatic diamines.

According to the '277 patent, the biphenyltetracarboxylic acid or its derivative (and optionally other aromatic tetracarboxylic acid or its derivative) and the phenylenediamine (and optionally other aromatic diamine) are polymerized together to give a polyamic acid and then imidized to give an aromatic polyimide having a high molecular weight in the known manner. The aromatic polyimide preferably has no secondary transition point because such polyimide shows high heat-resistance, high mechanical strength, and high dimensional stability.

The layer B (also layer-B') may be an aromatic polyimide which is derived from an aromatic tetracarboxylic acid or its derivative and an aromatic diamine having two or more benzene rings. Examples of the aromatic tetracarboxylic acid are 3,3',4,4'-biphenyltetracarboxylic acid, 2,3,3',4'-biphenyltetracarboxylic acid, 3,3',4,4'-benzophenonetetracarboxylic acid and 3,3',4,4'-diphenylethertetracarboxylic acid. Examples of their derivatives are their acid anhydrides and their esters. Their acid dianhydrides are preferred. Among these aromatic tetracarboxylic acids and their derivatives, biphenyltetracarboxylic acids or their derivatives are preferably employed. The biphenyltetracarboxylic acid or its derivative can be used in combination with other aromatic tetracarboxylic acids or their derivatives (e.g., dianhydride). Examples of the aromatic diamine having two or more benzene rings are diphenylether-type diamines, diaminodiphenylalkane-type diamines, diphenylsulfone-type diamine, di(aminophenoxy)benzenes, and di[(aminophenoxy)phenyl] sulfones. More specifically, 4,4'-diaminodiphenylether, 3,4'-diaminodiphenylether, 4,4'-diaminodiphenylsulfone, and 3,4'-diaminodiphenylsulfone can be mentioned. These diamines can be used alone or in combination with each other.

According to the '277 patent, the aromatic tetracarboxylic acid or its derivative and the aromatic diamine having two or more benzene rings are polymerized together to give a polyamic acid and then imidized to give an aromatic polyimide in the known manner. The resulting aromatic polyimide preferably has a secondary transition point in the range of 250° to 400° C., because such aromatic polyimide shows high heat-resistance as well as high thermal adhesiveness (adhesion using pressure and heat) with a metal foil.

U.S. Pat. No. 5,741,598 describes a polyimide/polyimide composite sheet. The sheet has a polyimide substrate film having a polyimide of a specific recurring unit (see formula 1 in the '598 patent) and a polyimide coat having a polyimide of a specific recurring unit (see formula 2 in the '598 patent). The polyimide substrate film is prepared by reaction of 3,4,3',4'-biphenyltetracarboxylic acid dianhydride (which may be referred to as "s-BPDA": "s" standing for "symmetric") and p-phenylenediamine (which may be referred to as "PPD"). According to the '598 patent, the p-phenylenediamine can be employed in combination with 4,4'-diaminodiphenyl ether (which may be referred to as "DADE") under the condition that the molar ratio of PPD/DADE is in the range of 100/0 to 70/30. The polyamide acid of s-BPDA and PPD/DADE can be prepared from s-BPDA and a mixture of PPD and DADE. Otherwise, a polyamide acid of s-BPDA/PPD and a polyamide acid of s-BPDA/DADE are independently prepared and then both polyamide acids are combined. The polyimide coat is produced from a polyamide acid (or polyamic acid) prepared by reaction of 2,3,3',4'-biphenyltetracarboxylic acid dianhydride (which may be referred to as "a-BPDA": "a" standing for "asymmetric") and 1,3-bis(4-aminophenoxy)benzene (which may be referred to as "TPE-R"). A metal may be fixed onto the polyimide/polyimide composite sheet by a hot melt method. According to the patent, the hot melt can be performed, preferably under the conditions of a temperature of 280° to 330° C., a pressure of 1 to 100 kgf/cm$^2$, and a period of 1 sec. to 30 min.

U.S. Pat. No. 6,605,366 describes an amorphous aromatic polyimide film that may be fixed under pressure with heating to a metal film having a smooth surface (e.g., stainless steel). The amorphous aromatic polyimide film is fixed to an aromatic polyimide substrate film. The substrate film has a non-thermoplastic aromatic polyimide base film and a thermoplastic aromatic polyimide layer, which contacts the amorphous aromatic polyimide film. The aromatic polyimide substrate film may have a single layer structure which can be made of thermoplastic polyimide resin. According to the '366 patent, the aromatic polyimide substrate film may, in another embodiment, be a multi-layered substrate film having a non-thermoplastic aromatic polyimide base film and one or two thin thermoplastic aromatic polyimide layers on one side or both sides of the base film. According to the '366 patent, the thermoplastic aromatic polyimide may be produced from the following combination of an aromatic tetracarboxylic dianhydride and an aromatic diamine compound: (1) 2,3,3',4'-biphenyltetracarboxylic dianhydride and 1,3-bis(4-aminophenoxybenzene); (2) a combination of 2,3,3',4'-biphenyltetracarboxylic dianhydride and 4,4'-oxydiphthalic dianhydride and 1,3-bis(4-aminophenoxy)-2,2-dimethylpropane; or (3) a combination of pyromellitic dianhydride and 4,4'-oxydiphthalic dianhydride and 1,3-bis(4-aminophenoxybenzene). The non-thermoplastic polyimide base film is composed of polyimide that may be produced from the following combination of a tetracarboxylic dianhydride and a diamine compound: (1) 3,3',4,4'-biphenyltetracarboxylic dianhydride (s-BPDA) and p-phenylenediamine (PPD); (2) 3,3',4,4'-biphenyltetracarboxylic dianhydride and a combination of p-phenylenediamine (PPD) and 4,4'-diaminodiphenyl ether (DADE), in which a molar ratio in terms of PPD/DADE preferably is more than 85/15; (3) a combination of 3,3',4,4'-biphenyltetracarboxylic dianhydride and pyromellitic dianhydride and a combination of p-phenylenediamine and 4,4'-diaminodiphenyl ether; (4) pyromellitic dianhydride and a combination of p-phenylenediamine (PPD) and 4,4'-diaminodiphenyl ether (DADE), in which a molar ratio in terms of PPD/DADE preferably is within 90/10 and 10/90; or (5) a combination of 3,3',4,4'-benzophenonetetracarboxylic dianhydride (BTDA) and pyromellitic dianhydride (PMDA) and a combination of p-phenylenediamine (PPD) and 4,4'-diaminodiphenyl ether (DADE), in which a molar ratio in terms of BTDA/PMDA preferably is within 20/80 and 90/10, and a molar ratio in terms of PPD/DADE preferably is within 30/70 and 90/10.

Self-bonding rebondable polyimides as described herein may be used in effectively any known microfluidic module construction. The microfluidic modules of commonly assigned U.S. Pat. No. 5,932,799, U.S. Pat. No. 6,073,482, U.S. Pat. No. 6,293,012, U.S. Pat. No. 6,406,605, and U.S. Pat. No. 6,551,496, all of which are incorporated herein by reference, may be modified and constructed using the adhesiveless self-bonding rebondable polyimide film to produce microfluidic modules.

Figure 12:
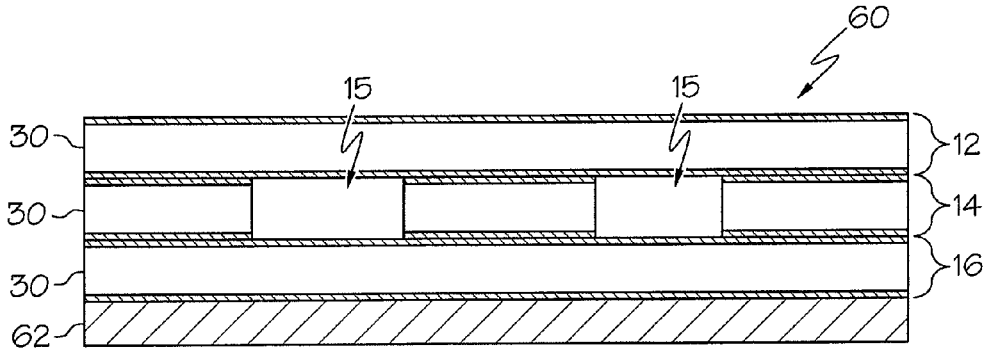
FIG. 12 is a sectional view of an embodiment of a microfluidic module including a metal reinforcing layer.

FIG. 1 is an example of a microfluidic module 10 having a first cover sheet 12, a channel sheet 14, and a second cover sheet 16. In one embodiment, these three sheets are self-bonding rebondable polyimide, but in another embodiment any one or more of the sheets can be a self-bonding rebondable polyimide. In particular, in other embodiments, one or both of the cover sheets could be a different plastic, for example a polyimide other than a self-bonding rebondable polyimide, or a metal film that is capable of being bonded to the rebondable polyimide without an adhesive. In FIG. 12, the microfluidic module includes a metal layer 62 that, among other advantages, makes the illustrated module easier to handle or adds support to the layers of the microfluidic. In certain embodiments, at least the channel sheet will be a self-bonding rebondable polyimide.

In FIG. 1, the channel sheet 14 is illustrated with two fluid flow channels 15 therein. In one embodiment, the microfluidic module may include a plurality of channel sheets. The channel sheet 14 may have one fluid flow channel or a plurality of fluid flow channels 15 therein. The term "fluid," as used herein, includes any material that is capable of flowing through the channels, especially gases, liquids, and solutions, suspensions, or dispersions of materials in gases or liquids. An advantage of using a self-bonding rebondable polyimide film is that it can be bonded to adjacent films without an adhesive. In FIG. 1, the top surface 24 of channel sheet 14 is shown directly bonded, without adhesive, in a superimposed relation to the bottom surface 21 of first cover sheet 12. Likewise, the bottom surface 25 of channel sheet 14 is shown directly bonded without adhesive in a superimposed relation to the top surface 27 of second cover sheet 16. FIG. 1 also shows top surface 21 of first cover sheet 12 and bottom surface 28 of second cover sheet 16. Even though this embodiment shows fluid flow channels 15 only in channel layer 14, there may be additional fluid flow channels in the first cover sheet 12 and/or the second cover sheet 16. In particular, there may be vertical channels 13 that link the flow of channels 15 to other modules or devices. Also, as described below, channels can be partially formed in the channel sheet 14 and the first and/or the second cover sheets (see FIG. 9B) or another adjacent channel sheet, which are assembled in registration with one another in a manner known in the art.

The fluid flow channels 15 may be of any shape or size sufficient to allow fluids to flow into or through reservoirs or other features within the microfluidic module. The channels 15 may be networks of channels. The network of channels may be interconnecting. In one embodiment, a microfluidic module may include a feature designed for the mixing of fluids therein. For fluids to flow into and out of the channels 15, there may be openings in the channels. In one embodiment, the channels 15 may be about 1 to about 1000 μm wide and about 0.1 to about 1000 μm deep.

In one embodiment, at least one of first cover sheet 12, channel sheet 14, or second cover sheet 16 is one or a plurality (e.g., a composite) of self-bonded films of the self-bonding rebondable polyimide film. In a more particular embodiment, a plurality (for example, two or more films) of the adhesiveless self-bonding rebondable polyimide films may be heat and/or press laminated to make up the first cover sheet 12, the channel sheet 14, and/or the second cover sheet 16. In one embodiment, the channel sheet 14 may be about 25 μm to 1000 μm thick and the cover sheets may be about 25 μm to 1000 μm thick.

Figure 2:
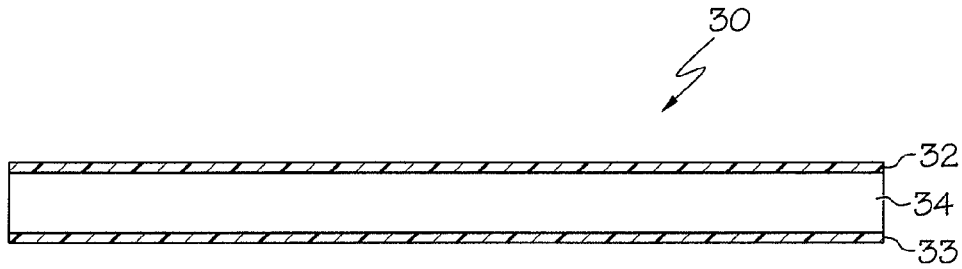
FIG. 2 is a sectional view of one embodiment of a sheet of adhesiveless self-bonding rebondable polyimide film.

In another embodiment, as shown in FIG. 2, the rebondable polyimide film 30 may be a composite film, e.g., see U.S. Pat. No. 6,605,366, that includes a thermoplastic polyimide, on the top surface 32 and/or bottom surface 33. In yet another embodiment, a non-thermoplastic polyimide 34 may be sandwiched between the top surface 32 and the bottom surface 33 of thermoplastic polyimide.

Figure 3:
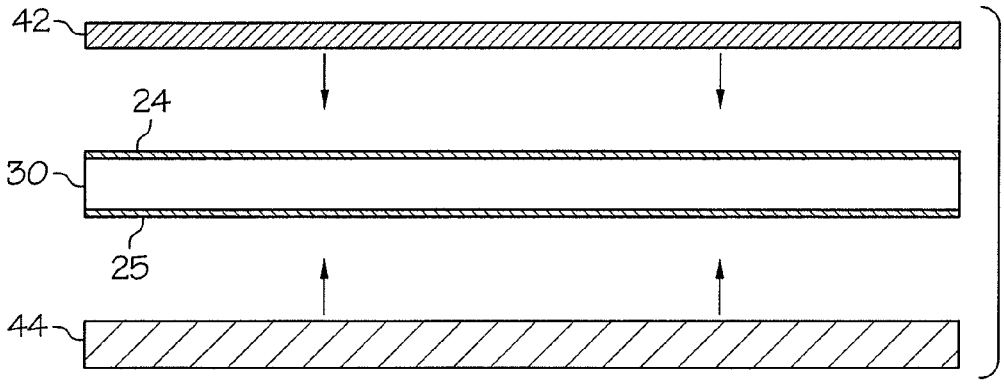
FIG. 3 is a sectional view illustrating forming a sheet of masked adhesiveless self-bonding rebondable polyimide.

In another embodiment, as shown in FIG. 3, a sheet of masked adhesiveless self-bonding rebondable polyimide may have a first mask layer 42 and a second mask layer 44 with the adhesiveless self-bonding rebondable polyimide film 30 therebetween. The first mask layer 42 and the second mask layer 44 may be metal, plastic, or other films conventionally used as mask layers. In one embodiment, the first and second mask layers 42, 44 may be copper, stainless steel, aluminum, gold, or any other metal, or silicon, glass, or other material that bonds to the adhesiveless self-bonding rebondable polyimide, and can be etched by a process that will not etch the polyimide. The mask layer(s) stabilize, strengthen, and/or hold the adhesiveless self-bonding rebondable polyimide in place during lamination, bonding, rebonding, and/or etching of the mask layer and/or the polyimide. In one embodiment, for example see FIG. 12, a metal layer may be used for its structural properties or distinguished from its use as a mask layer. In one embodiment, the first mask layer 42 may be copper and the second mask layer 44 may be stainless steel. In one embodiment, the mask layers 42, 44 may be about 1000 Å to 50 μm thick. The mask layers may be bonded directly to the adhesiveless self-bonding rebondable polyimide 30 without adhesive by any of the following methods or other methods known in the art. In another embodiment, metal layers may be applied using sputtering, e-beam, or vapor deposition processes.

An autoclave method utilizes the pressures created by heating a compressed gas, such as nitrogen, in an enclosed space. The materials to be laminated are placed within a bag, which is evacuated and then sealed. The forces of the expanding vapor inside the confines of the autoclave exert pressure upon the bag surface thereby creating the conditions needed for bonding. The pressure may be hydrostatic pressure due to the vapor or the liquid within the autoclave.

A heated press method utilizes a heated platen in combination with a hydraulically, or otherwise mechanically, driven press to create the needed conditions.

Another method uses a high temperature oven in combination with a pressing fixture to accomplish bonding. In this method, the materials to be bonded are stacked in registration between metal platens connected to each other via a plurality of bolts, clamps, or the like, which, after tightening, hold the platens from moving apart from one another. This assembly is placed inside an oven and heated to the required bonding temperature while pressure is exerted upon the lamina inside the metal platens to cause the layers to bond.

In one embodiment, a plurality of adhesiveless self-bonding rebondable polyimide films may be stacked between a copper first mask layer and a stainless steel second mask layer. The bonding operation may be carried out, in the autoclave or other bonding apparatus, at temperatures of about 200° to about 400° C. for adhesiveless self-bonding rebondable polyimide films and at pressures of about 300 to about 400 psi (about 2000 KPa (20 bar) to about 2800 KPa (28 bar)) for a period of about 5 minutes to about 30 minutes. In one embodiment, the bonding may be carried out at about 300° C. with no added pressure. In another embodiment, the bonding operation may be carried out for a period of about 5 minutes to about 3 hours.

Figure 4:
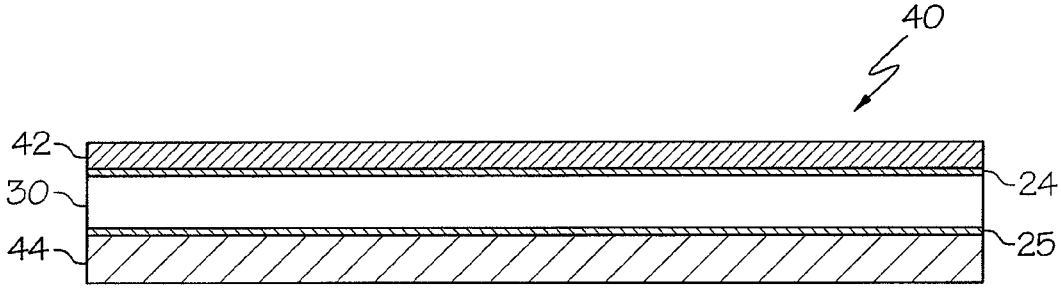
FIG. 4 is a sectional view of the masked adhesiveless self-bonding rebondable polyimide after bonding of the layers or sheets.

FIG. 4 shows a sheet of the masked adhesiveless self-bonding rebondable polyimide 40 after bonding. The sheet includes a first mask layer 42 and a second mask layer 44 having the adhesiveless self-bonding rebondable polyimide 30 bonded therebetween, such that the mask layers 42, 44 are on opposite sides of the adhesiveless self-bonding rebondable polyimide 30 from one another. The masked adhesiveless self-bonding rebondable polyimide 40, as shown in FIG. 4, includes one sheet of the adhesiveless self-bonding rebondable polyimide film 30; however, the masked adhesiveless self-bonding rebondable polyimide 40 is not limited thereto and may include multiple film layers, e.g., multiple laminates of the composite film shown in FIG. 2.

Figure 5A:
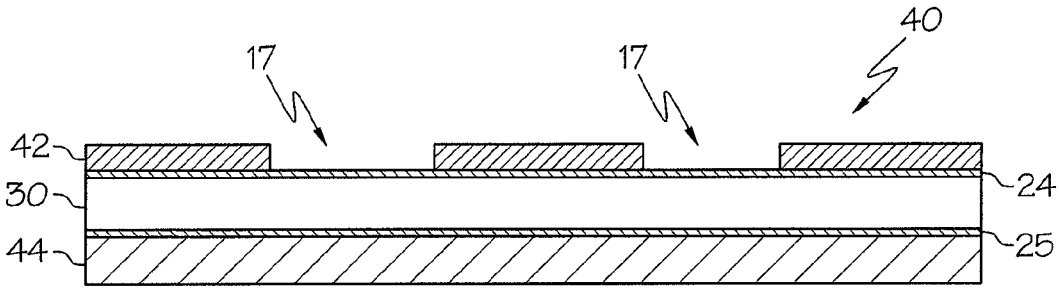
FIGS. 5A and 5B are sectional views of a mask layer(s) having a fluidic pattern therein.
Figure 5B:
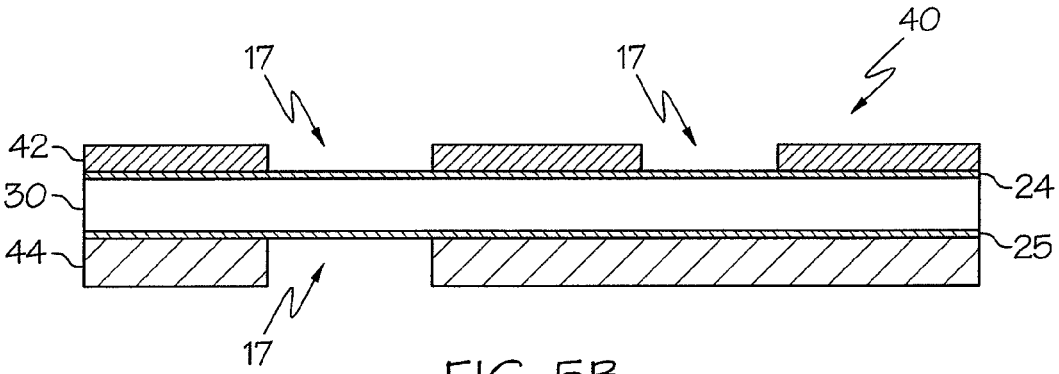

FIGS. 5A and 5B illustrate that the first mask layer 42 and/or the second mask layer 44 of the sheet of masked adhesiveless self-bonding rebondable polyimide 40 include a fluidic pattern 17. The fluidic pattern 17 may be any design that corresponds to the selected placement of channels or other features to be formed in the adhesiveless self-bonding rebondable polyimide 30. The fluidic pattern 17 may be etched into the first and/or second mask layers 42, 44 using etching techniques known in the art. For example, the mask layer may be etched using photolithographic etching techniques. Photolithographic etching may be particularly useful when the mask layer is a metal. The photolithographic etching creates openings in the metal that correspond to the locations where the rebondable polyimide will be subsequently removed. In one embodiment, as shown in FIG. 5A, the first mask layer 42 is etched with a fluidic pattern 17, while the second mask layer 44 is un-etched. In another embodiment, as shown in FIG. 5B, the first mask layer 42 and the second mask layer 44 are both etched with a fluidic pattern 17.

Figure 6A:
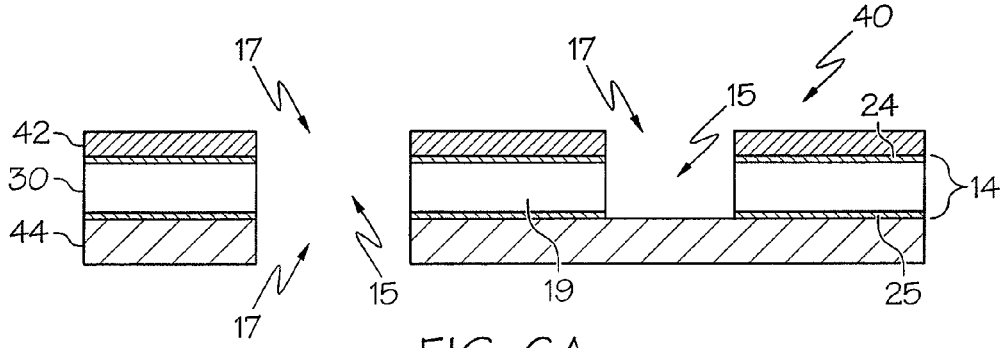
FIGS. 6A and 6B are sectional views of the masked adhesiveless self-bonding rebondable polyimide having channels (FIG. 6A) or partial channels (FIG. 6B) therein.
Figure 6B:
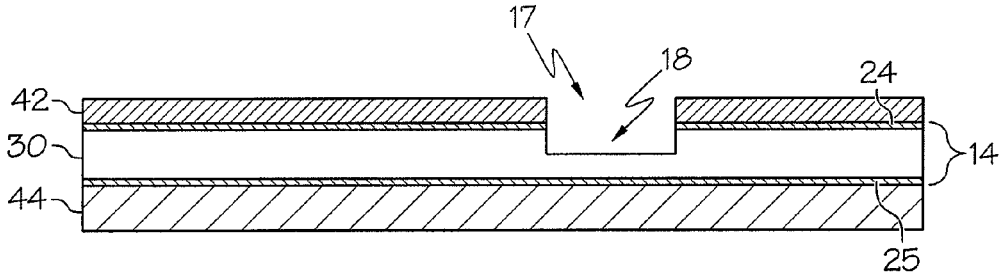

FIGS. 6A and 6B show the masked adhesiveless self-bonding rebondable polyimide 40 having channels 15 formed therein. As shown in FIG. 6A, the masked adhesiveless self-bonding rebondable polyimide 40 includes a channel sheet 14 having a fluid flow channel 15, a first mask layer 42 on the top surface 24 of the channel sheet and a second mask layer 44 on the bottom surface 25 of the channel sheet. Both the first mask layer 42 and the second mask layer 44 include a fluidic pattern 17. The first or second mask layer also functions to allow the adhesiveless self-bonding rebondable polyimide to be etched completely through while holding islands 19 of the adhesiveless self-bonding rebondable polyimide in place relative to one another. As shown in FIG. 6B, the masked adhesiveless self-bonding rebondable polyimide 40 includes a channel sheet 14 having a partial fluid flow channel 18, a first mask layer 42 on the top surface 24 of the channel sheet and a second mask layer 44 on the bottom surface 25 of the channel sheet, where the first mask layer 42 includes a fluidic pattern 17.

Channels 15 (FIG. 6A) and/or the partial channels 18 (FIG. 6B) may be formed in the adhesiveless self-bonding rebondable polyimide film 30 to form the channel sheet 14. The channels 15 or partial channels 18 may be formed through the fluidic pattern 17 in the mask layers 42 and/or 44 into the adhesiveless self-bonding rebondable polyimide film 30 by conventional methods such as microlithographic etching techniques, including wet, plasma, laser, ion, e-beam etching, or the like. In other embodiments, the channels may be formed via mechanical methods such as milling, scribing or higher pressure article stream methods, or a combination of any of the above-mentioned methods.

The fluid flow channels 15 and/or partial channels 18 may include, but are not limited to, a feed channel, a sensor channel, an inlet channel, an egress channel, and/or a micro-reactor channel. Any of these fluid flow channels 15 may be branched. A feed channel is a fluid flow channel that provides for feed of calibrant, buffer, analyte, or other solutions into the microfluidic module or for mixing of chemicals or solutions therein. These solutions may be used within the microfluidic module to detect analyte presence and/or concentration. A sensor channel is a fluid flow channel that is adapted so that a sensing element can measure selected data about the fluid within the channel. In one embodiment, the sensing element may be included in the fluid flow channel. In another embodiment, the sensing element may be external to the fluid flow channel; for example, the fluid flow channel may include a window and a sensing element adjacent the window that may measure selected data through the window. The sensing element may be an electrode, working electrode, counter-electrode, an optical sensing element, an electrochemical sensing element, and/or a microporous sensor. The sensing element should be capable of measuring the analyte as it flows past the sensing element. The electrochemical sensing element may include, but is not limited to, an amperometric, potentiometric, or conductimetric element(s). The sensing element may be formed along the sensor channel, as described in the '799 and the '482 patents. In one embodiment, in one fluid flow channel multiple sensing elements may be in an in-line series disposition along the channel to allow multiple analysis to be conducted. An inlet channel is a fluid flow channel that allows fluid to flow into a feature of the microfluidic module. An egress channel is a fluid flow channel that allows fluid to flow from a feature of the microfluidic module. In one embodiment, the inlet and/or egress channels may be disposed within the microfluidic module. In another embodiment, the inlet and/or egress channels may terminate in top surface 21 or bottom surface 28 (FIG. 1). A micro-reactor may be made by immobilizing biomolecules, such as enzymes, catalytic entities, or the like, within features in the microfluidic module.

Figure 7A:
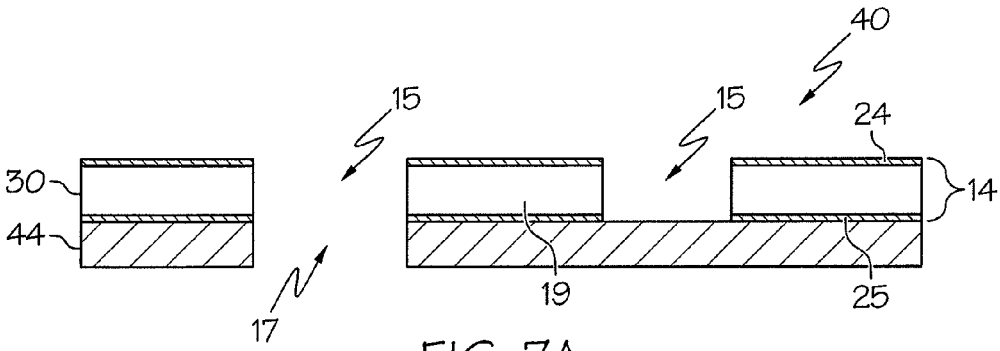
FIGS. 7A-7C are sectional views of the masked adhesiveless self-bonding rebondable polyimide after removal of the mask layer from the top surface.
Figure 7B:
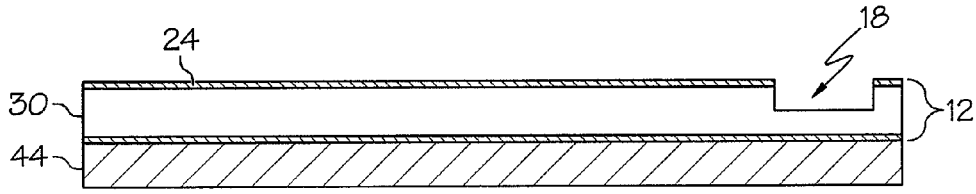
Figure 7C:
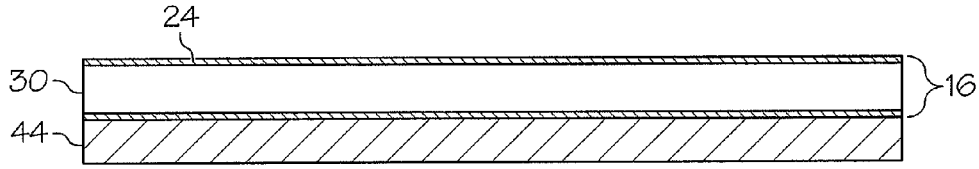

FIGS. 7A-7C show the masked adhesiveless self-bonding rebondable polyimide 40 in which one of the mask layers is removed. By selecting appropriate materials/metals for the mask layers, as described herein, the mask layers can be selectively and sequentially removed. The first mask layer 42 and/or the second mask layer 44 may be removed. FIG. 7A illustrates a channel sheet 14 having a mask layer 44. FIG. 7B illustrates a first cover sheet having a partial fluid flow channel 18 formed therein and a mask layer 44. FIG. 7C illustrates a second cover sheet 16 including a mask layer 44. Any of the sheets illustrated in FIGS. 7A-7C may include channels 15, partial channels 18, vertical channels 13 (show in FIG. 1), or any other feature disclosed herein.

The mask layers may be removed by any suitable method that will not damage the underlying adhesiveless self-bonding rebondable polyimide film 30. In one embodiment, a method may be selected to remove the first mask layer 42 without removing the second mask layer 44. In one embodiment, the mask layer to be removed may be metal and a chemical solution may be used to remove the metal. In one embodiment, the first mask layer 42 may be copper. An ammonium persulphate solution may be used to remove the copper. In another embodiment, the second mask layer 44 may be stainless steel. A ferric chloride solution may be used to remove the stainless steel. The ammonium persulphate solution used to remove the copper mask layer 42 will not remove a second metal layer 44 of stainless steel, such that the metal layers may be removed or retained selectively.

Figure 8A:
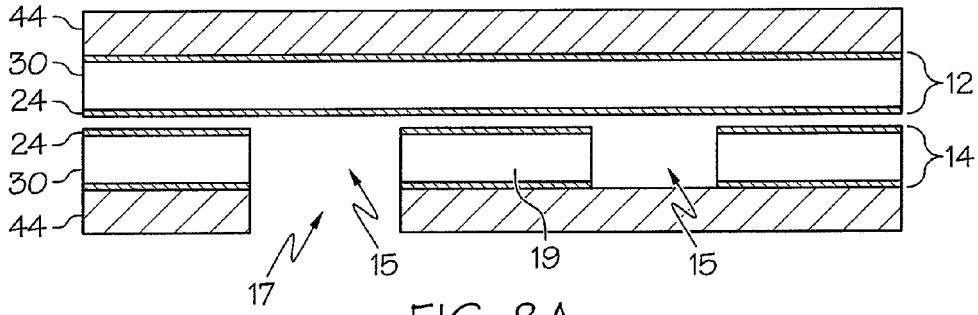
FIGS. 8A and 8B illustrate a channel sheet and a cover sheet each including a metal layer prior to bonding.
Figure 8B:
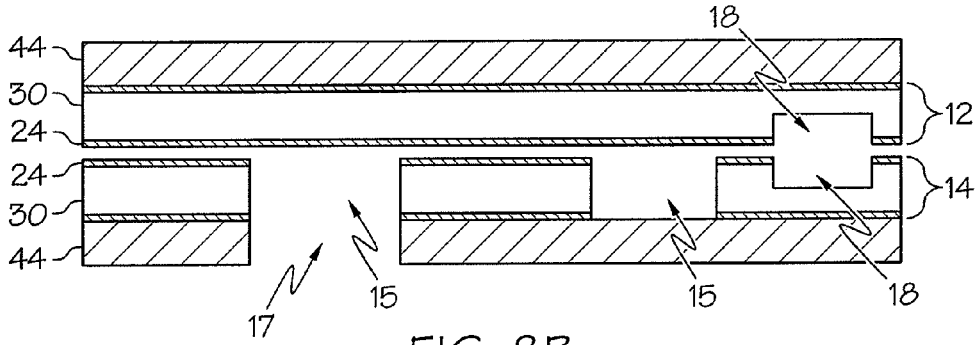

FIGS. 8A and 8B illustrate a channel sheet 14 and the cover sheet 12 prior to being bonded together by the adhesiveless self-bonding rebondable polyimide films 30. The element shown in FIG. 8A is obtained by removing one of the mask layers from the channel sheet. The exposed first surfaces 24 of the adhesiveless self-bonding rebondable polyimide film 30 face one another such that the channels 15 are appropriately positioned before bonding the sheets 12, 14 together. FIG. 8B shows one embodiment in which a channel sheet 14 with a mask layer and a first cover sheet 12 with a metal reinforcing layer that have their exposed first surfaces 24 of the adhesiveless self-bonding rebondable polyimide film 30 facing one another such that the partial channels 18 are aligned at the interface of the sheets.

It will be apparent that the step of bonding of the adhesiveless self-bonding rebondable polyimide films 30 of the first cover sheet 12 and the channel sheet 14 represents a second bonding (rebonding) of the adhesiveless self-bonding rebondable polyimide film 30, since the adhesiveless self-bonding rebondable polyimide film's 30 first surface 24 of both the first cover sheet 12 and the channel sheet 14 are previously bonded to the mask or reinforcing layer. This rebonding step without adhesive is possible due to the rebondable property of the polyimide films used herein. The bonding of the channel sheet 14 to the first cover sheet 12 may be by any of the methods described above or known methods in the art for the adhesiveless self-bonding rebondable polyimide and the mask layers. In one embodiment, a high temperature autoclave may be used for the step of bonding. These bonding operations may include placing the respective sheets between an upper platen placed on top of the sheets and a lower platen placed on the bottom. In one embodiment, a sheet or film of another material may be between the platen and the adhesiveless self-bonding rebondable polyimide surface nearest the platen to keep the rebondable polyimide from bonding to the platen. The sheet or film may be a metal or an adhesiveless self-bonding polyimide, such as UPILEX®-S by UBE Industries. The platens may include registration pins to keep the fluid flow channels, ports, and other features of the channel sheet, first cover sheet, and second cover sheet in superimposed and/or correct registration. In one method, the sheets between the platens may be heated at about 250° C. to about 350° C. for about 1.5 hours to about 2.5 hours. In another embodiment, the sheets may be heated for about 1 hour to about 3 hours. In one method, the platens may be hydraulically driven together to form a pressure nip on the layers. In another method, heavy cell plates with perimeter bolts may be used to increase the pressure on the sheets.

Figure 9A:
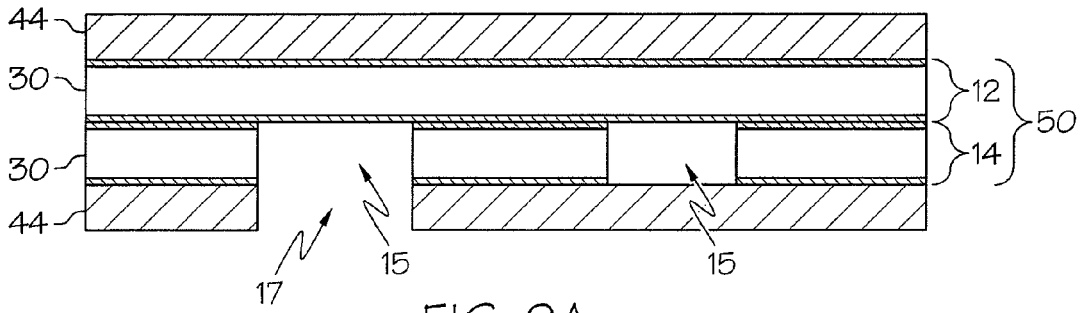
FIGS. 9A and 9B are sectional views of a cover sheet bonded directly to a channel sheet, the cover sheet and channel sheet include a metal layer.
Figure 9B:
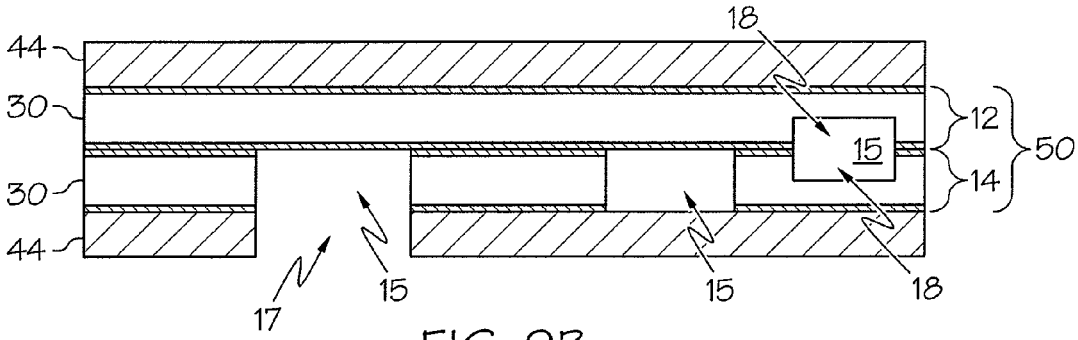

FIGS. 9A and 9B show the adhesiveless self-bonding rebondable polyimide films 30 of the first cover sheet 12 bonded directly to the channel sheet 14 without adhesive. In one embodiment, as shown in FIG. 9A, the bonded adhesiveless self-bonding rebondable polyimide films 30 includes channels 15 that extend through the sheet 14. In one embodiment, as shown in FIG. 9B, a fluid flow channel 18 may be partially formed in the interfacing surface portions of the first cover sheet 12 and/or in channel sheet 14, or the second cover sheet 16 and/or in channel sheet 14 such that when directly bonded in registration in a superimposed relation a fluid flow channel 15 is formed as described in commonly assigned U.S. Pat. No. 5,932,799 (the '799 patent) and U.S. Pat. No. 6,073,482 (the '482 patent). In one embodiment, the second mask layers 44 may both be stainless steel. In another embodiment, at least one of the metal layers may be etched with a fluidic pattern 17.

Figure 10:
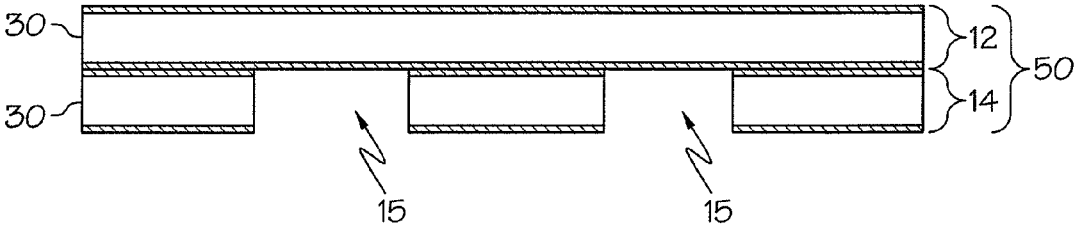
FIG. 10 is a sectional view of an intermediate useful in forming the microfluidic module in accordance with one embodiment.

FIG. 10 shows one embodiment of a two-layer element 50 useful in forming microfluidic modules. The two-layer element 50 is formed by removing the mask layers from the channel sheet 14 and bonding the cover sheet 12 to the channel sheet 14 as described above.

Figure 11:
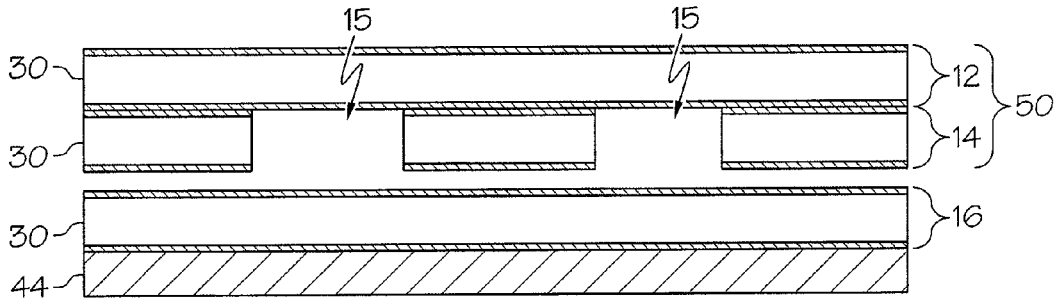
FIG. 11 is a sectional view of the second cover sheet and the intermediate of FIG. 10 before bonding them together.

FIG. 11 illustrates the second cover sheet 16 and the element 50, which includes the first cover sheet 12 bonded to the channel sheet 14, prior to being bonded together without adhesive by the adhesiveless self-bonding rebondable polyimide films 30. In one embodiment, as shown in FIG. 11, the second cover sheet 16 and the two-layer intermediate 50 are positioned with the exposed first surface 24 of the second cover sheet 16 and the exposed second surface 25 of the channel sheet 14 of the two-layer element 50 facing one another prior to bonding. The sheets are appropriately positioned to form channels 15 or other features in the adhesiveless self-bonding rebondable polyimide films. In one embodiment, the element 50 may only have the second mask layer 44 removed from the second surface 25 of the channel sheet 14 to expose the second surface 25 for bonding to the second cover sheet 16 including a mask layer 44.

The bonding of the element 50 to the second cover sheet 16 may be by any of the methods described above for the adhesiveless self-bonding rebondable polyimide and the mask layers. This bonding represents a rebonding of the adhesiveless self-bonding rebondable polyimide films 30 because previously the adhesiveless self-bonding rebondable polyimide film's 30 first surface 24 and/or second surface 25 of element 50 was bonded to a mask layer. In another embodiment, the bonding of the first cover sheet 12 and the second cover sheet 16 to the channel sheet 14 may be performed in one step where the sheets are directly bonded to one another without adhesive. Once again, the bonding may be by any of the methods described above for the adhesiveless self-bonding rebondable polyimide and the mask layers.

FIG. 12 shows one embodiment of a microfluidic module 60. The microfluidic module 60 includes a channel sheet 14, a first cover sheet 12, a second cover sheet 16 and a mask layer 62, which may be metal. Channel sheet 14 includes a fluid flow channel 15 formed therein. The fluid flow channel 15 may be formed by etching as described above. The first cover sheet 12 is directly bonded without adhesive to channel sheet 14 by the adhesiveless self-bonding rebondable polyimide to cover fluid flow channel 15. The second cover sheet 16 is also directly bonded without adhesive to channel sheet 14 opposite the first cover sheet 12 by the adhesiveless self-bonding rebondable polyimide of the channel sheet. While all three sheets 12, 14 and 16 may be rebondable polyimide films as described above, embodiments are included herein where only sheet 14 may be rebondable polyimide as well as embodiments in which sheets 12 and 16 are rebondable and sheet 14 is a different film.

The cover sheets may include a port (as described below), a vertical channel (see FIG. 1), or any other feature disclosed herein. The mask layer 62 may be directly bonded (preferably without adhesive) to the second cover sheet 16 opposite channel sheet 14. The mask layer 62 may be removed from the second cover sheet 16 to reveal a microfluidic module similar to that shown in FIG. 1 or the mask layer may be left in place to facilitate handling.

Alternatively, the mask layer may be used to improve the firmness of the polyimide layer to make the module easier to handle or manipulate. Thus, the present invention includes embodiments in which the mask layer is used as a mask and as an intermediate that is useful in forming the microfluidic module. The invention also includes embodiments in which the mask layer forms part of the microfluidic module itself to provide structural support and make the film easier to manipulate. In the latter case, the metal layer is not removed in the fabrication process. The mask layer may function as a shield to protect the microfluidic module from damage from the surroundings. In one embodiment, the mask layer may be copper, which may act as a capacitor, an electrical conductor, or take part in a chemical reaction. In one embodiment, the mask layer may be stainless steel and may have an electrical pathway designed therein, or the stainless steel may be coated with silver to function as an electrode.

In another embodiment, the fluidic design for the first cover sheet 12 and/or the second cover sheet 16 may include a port (not shown in the figures). The port may be an opening or channel that allows fluid(s) to move or be transferred between features within the microfluidic module, or between the exterior of the module and the interior of the module. The port may be etched as described above for a sheet having a first metal layer and/or a second metal layer, or a sheet of only rebondable polyimide. The port may be partially positioned over a fluid flow channel 15 to be in fluid flow communication with the fluid flow channel 15. The port may be any size and shape opening as needed to suitably allow fluid communication between the exterior of the microfluidic module and fluid flow channel 15, or between various interior features of the microfluidic module, e.g., a reservoir, a valve, a fluid flow channel, a feed channel, a sensor channel. In one embodiment, the port may provide access to the channel layer's 14 fluid flow channel 15 from the top surface 21 of first cover sheet 12, from the bottom surface 28 of second cover sheet 16, or from both. In another embodiment the port may extend partially through the first cover sheet 12 and/or the second cover sheet 16 to provide a pathway between interior features of the microfluidic module.

In one embodiment, the microfluidic module may include a valve region. The valve region may selectively block or allow communication between the feed and sensor channels. The valve region may be as described in the '799 patent, the '482 patent, or the '605 patent, which are incorporated above. The valve region may include a reservoir, an electroosmotic flow membrane, a diaphragm, a pump, a valve, and channels leading into and/or out of the valve region. Alternatively, a valve construction as described in U.S. Pat. Nos. 4,848,722, 4,858,883, 4,304,257, 4,852,851 or 5,660,370 to Webster may be used.

The microfluidic module may include one or more multiple fluid flow channels including a feed channel, a sensor channel, valve region and a sensing element to detect or analyze different analytes.

The preceding description and accompanying drawings are intended to be illustrative of the present invention and not limited. Various other modifications and applications will be apparent to one skilled in the art without departing from the true spirit and scope of the invention as defined by the following claims.

What is claimed is:

1. A method of making a microfluidic module comprising:

providing a self-bonding polyimide film having a first major surface and a second major surface;

bonding, without adhesive, the first major surface of the self-bonding polyimide film to a first mask layer;

forming a fluid flow channel in the self-bonding polyimide film, removing the first mask layer from the first major surface of the self-bonding polyimide film after forming the fluid flow channel; and re-bonding, without adhesive, the first major surface of the self-bonding polyimide film, exposed by removal of the first mask layer, to a first cover sheet.

2. The method of claim 1 wherein the forming of the fluid flow channel includes etching the first mask layer with a fluidic pattern and etching the fluid flow channel into the self-bonding polyimide film through the etched first mask layer.

3. The method of claim 1 wherein the self-bonding polyimide film is a composite film that includes a thermoplastic polyimide in at least a top surface and a bottom surface of the film.

4. The method of claim 1 wherein at least one of the bonding step and the re-bonding step includes application of heat and/or pressure.

5. The method of claim 4 wherein the bonding step or the re-bonding step includes heating at about 275° C. to about 325° C. for about 5 minutes to about 3 hours.

6. The method of claim 5 wherein the bonding step or re-bonding step includes applying pressure of about 300 to about 400 psi.

7. The method of claim 1 wherein the first cover sheet is plastic, polyimide, self-bonding polyimide, or metal.

8. The method of claim 1 wherein the first mask layer includes metal, silicon, or glass.

9. The method of claim 1 wherein the self-bonding polyimide film includes a second mask layer bonded thereto, without adhesive, on the second major surface opposite the first mask layer.

10. The method of claim 9 wherein at least one of the first and second mask layers is metal.

11. The method of claim 10 wherein the first mask layer includes copper.

12. The method of claim 11 wherein the second mask layer includes stainless steel.

13. The method of claim 9 further comprising removing the second mask layer, after the step of re-bonding the first major surface of the self-bonding polyimide film to the first cover sheet.

14. The method of claim 13 further comprising re-bonding the second major surface of the self-bonding polyimide film, exposed by removal of the second mask layer, to a second cover sheet.

15. The method of claim 1 wherein the removing of the first mask layer includes exposing the first mask layer to a chemical solution.

16. The method of claim 9 wherein the removing of the first mask layer includes exposing the first mask layer to a chemical solution that removes the first mask layer without removing the second mask layer.

17. The method of claim 1 further comprising simultaneously bonding, without adhesive, the first mask layer to the first major surface and a second mask layer to the second major surface of self-bonding polyimide film.

* * * * *